US009190251B2

(12) United States Patent
Green et al.

(10) Patent No.: US 9,190,251 B2
(45) Date of Patent: Nov. 17, 2015

(54) PRE-SCAN FOR MASS TO CHARGE RATIO RANGE

(75) Inventors: Martin Raymond Green, Bowdon (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 19 days.

(21) Appl. No.: 14/004,520

(22) PCT Filed: Mar. 13, 2012

(86) PCT No.: PCT/GB2012/050546

§ 371 (c)(1), (2), (4) Date: Oct. 29, 2013

(87) PCT Pub. No.: WO2012/123731

PCT Pub. Date: Sep. 20, 2012

(65) Prior Publication Data

US 2014/0048701 A1 Feb. 20, 2014

Related U.S. Application Data

(60) Provisional application No. 61/481,384, filed on May 2, 2011.

(30) Foreign Application Priority Data

Mar. 14, 2011 (GB) ..... 1104225.6

(51) Int. Cl.
*H01J 49/00* (2006.01)

(52) U.S. Cl.
CPC ..... *H01J 49/004* (2013.01); *H01J 49/0031* (2013.01)

(58) Field of Classification Search
CPC ..... H01J 49/004; H01J 49/0031
USPC ..... 250/281–300
See application file for complete search history.

(56) References Cited

U.S. PATENT DOCUMENTS

| | | | | |
|---|---|---|---|---|
| 4,837,434 | A * | 6/1989 | James | 250/281 |
| 6,534,764 | B1 | 3/2003 | Verentchikov et al. | |
| 6,717,130 | B2 | 4/2004 | Bateman et al. | |
| 7,759,641 | B2 | 7/2010 | Hasegawa et al. | |

(Continued)

OTHER PUBLICATIONS

Guna et al., "*Performance Enhancements of Mass Selective Axial Ejection From a Linear Ion Trap*", American Society for Mass Spectrometry, vol. 20, pp. 1132-1140, 2009.

(Continued)

*Primary Examiner* — Jack Berman
(74) *Attorney, Agent, or Firm* — Diederiks & Whitelaw, PLC

(57) ABSTRACT

A method of mass spectrometry is disclosed comprising performing a first analysis of a sample of ions wherein one or more parameters are scanned and/or ions are sorted according to one or more parameters during the first analysis. One or more ranges of interest of the one or more parameters from the first analysis are then automatically determined. A second subsequent analysis of the sample of ions is then automatically performed, wherein the second analysis is restricted to one or more of the ranges of interest of the one or more parameters.

20 Claims, 3 Drawing Sheets

(56) References Cited

U.S. PATENT DOCUMENTS

| | | | | |
|---|---|---|---|---|
| 7,771,943 | B2 | 8/2010 | Blanksby et al. | |
| 8,269,166 | B2 | 9/2012 | Okumura | |
| 2004/0183009 | A1 | 9/2004 | Reilly et al. | |
| 2004/0248317 | A1 * | 12/2004 | Swamy et al. | 436/173 |
| 2010/0301202 | A1 | 12/2010 | Vestal | |

OTHER PUBLICATIONS

Vinzenz et al., "*Selected Reaction Monitoring for Quantitative Proteomics: A Tutorial*", Molecular Systems Biology, vol. 4, No. 222, 2008.

* cited by examiner

PRE-SCAN FOR MASS TO CHARGE RATIO RANGE

CROSS-REFERENCE TO RELATED APPLICATIONS

This application is the National Stage of International Application No. PCT/GB2012/050546, filed 13 Mar. 2012, which claims priority from and the benefit of U.S. Provisional Patent Application Ser. No. 61/481,384 filed on 2 May 2011 and United Kingdom Patent Application No. 1104225.6 filed on 14 Mar. 2011. The entire contents of these applications are incorporated herein by reference.

BACKGROUND TO THE INVENTION

The present invention relates to a mass spectrometer and a method of mass spectrometry.

Tandem mass spectrometry such as tandem quadrupole ("QqQ") and quadrupole Time of Flight ("QToF") mass spectrometers have proved to be an invaluable tool in many applications. Tandem quadrupole instruments, in particular, have found roles in screening applications using semi targeted analyses such as parent or precursor ion scans and neutral loss scans. These types of analyses typically involve fragmenting ions exiting a scanning mass to charge ratio mass filter and using a second mass to charge ratio mass filter to target a particular fragment ion or fragment loss. As the first step of mass analysis is via a scanning mass filter, the duty cycle, and consequently the sensitivity, is reduced depending on the resolution of the mass filter and the mass to charge ratio range scanned.

To a first approximation, and for illustrative purposes only, the transmission characteristics of a mass to charge ratio mass filter can be approximated as having a uniform profile of width W Da, wherein the value of W is related to the instrument resolution. If the mass to charge ratio range to be scanned is denoted as Rg Da and the mass filter scanning speed is denoted as Sp Da/s then the length of time spent scanning across any particular mass to charge ratio is given by W/Sp (s) and the time spent for the full range scan is given by Rg/Da (s). The duty cycle is therefore given by (W/Sp)/(Rg/Sp) which simplifies to W/Rg.

A particular disadvantage, therefore, of known scanning instruments such as quadrupole mass analysers is that they suffer from low duty cycle.

A method of Automatic Gain Control ("AGC") is known which involves automatically controlling the number of ions entering a mass analyser by performing a pre-scan to determine the Total Ion Charge ("TIC"), An ion injection time is then calculated for the analytical scan based upon the determination of the Total Ion Charge. This approach prevents space charge saturation of the mass analyser.

It is desired to provide an improved mass spectrometer.

SUMMARY OF THE PRESENT INVENTION

According to an aspect of the present invention there is provided a method of mass spectrometry comprising:

performing a first analysis of a sample of ions wherein one or more parameters are scanned and/or ions are sorted according to one or more parameters during the first analysis;

automatically determining one or more ranges of interest of the one or more parameters from the first analysis; and automatically performing a second subsequent analysis of the sample of ions, wherein the second analysis is restricted to one or more of the ranges of interest of the one or more parameters.

The first analysis and the second analysis may be performed using the same first analytical device. According to this embodiment the first analytical device is operated at a first resolution to perform the first analysis and is then operated at a second higher resolution to perform the second analysis.

Alternatively, the first analysis may be performed using a first analytical device and the second analysis may be performed using a second different analytical device. According to this embodiment the first analytical device is operated at a first resolution to perform the first analysis and the second analytical device is operated at a second higher resolution to perform the second analysis.

The parameter may comprise the mass or mass to charge ratio of the ions. According to this embodiment the first analytical device and/or the second analytical device comprise a mass analyser. The first analysis preferably comprises the mass analysis of parent ions and wherein the second analysis preferably comprises the mass analysis of similar parent ions. The first analysis may alternatively comprise the mass analysis of first generation, second generation, third generation or subsequent generation fragment ions and the second analysis may comprise the mass analysis of similar first generation, second generation, third generation or subsequent generation fragment ions.

According to another embodiment the parameter may comprise ion mobility. According to this embodiment the first analytical device and/or the second analytical device comprise an ion mobility spectrometer.

According to a less preferred embodiment the parameter may comprise collision energy.

According to a less preferred embodiment the parameter comprises ionisation energy or Electron Impact ionisation energy.

According to a less preferred embodiment the parameter may comprise Electron Transfer Dissociation conditions such as the mixing or reaction time between reagent anions and analyte cations (e.g. in an Electron Transfer Dissociation fragmentation device).

The second analysis is preferably restricted to one or more of the ranges of interest of the one or more parameters by filtering out ions having values of the one or more parameters which fall outside the one or more ranges of interest.

The second analysis is preferably substantially similar to the first analysis.

The ions analysed during the second analysis are preferably substantially similar to the ions analysed during the first analysis.

Restricting the second analysis to analysing ions having one or more ranges of interest of the one or more parameters preferably has the effect of increasing the duty cycle.

According to another aspect of the present invention there is provided amass spectrometer comprising:

an analyser; and a control system arranged and adapted:

(i) to perform a first analysis of a sample of ions wherein one or more parameters are scanned and/or ions are sorted according to one or more parameters during the first analysis;

(ii) to determine one or more ranges of interest of the one or more parameter from the first analysis; and (iii) to perform a second subsequent analysis of the sample of ions, wherein the second analysis is restricted to one or more of the ranges of interest of the one or more parameters.

According to another aspect of the present invention there is provided a method of mass spectrometry comprising:

performing a first analysis of a sample of ions wherein ions are mass analysed during the first analysis;

automatically determining one or more mass to charge ratio ranges of interest from the first analysis; and automatically performing a second subsequent mass analysis of the sample of ions, wherein the second analysis is restricted to mass analysing ions having mass to charge ratios within one or more of the mass to charge ratio ranges of interest.

The first analysis preferably comprises the mass analysis of parent ions and wherein the second analysis preferably comprises the mass analysis of similar parent ions.

The first analysis preferably comprises the mass analysis of first generation, second generation, third generation or subsequent generation fragment ions and the second analysis preferably comprises the mass analysis of similar first generation, second generation, third generation or subsequent generation fragment ions.

According to another aspect of the present invention there is provided a mass spectrometer comprising:

a mass analyser; and a control system arranged and adapted:

(i) to perform a first analysis of a sample of ions wherein ions are mass analysed during the first analysis;

(ii) to determine one or more mass to charge ratio ranges of interest from the first analysis; and (iii) to perform a second subsequent mass analysis of the sample of ions, wherein the second analysis is restricted to mass analysing ions having mass to charge ratios within one or more of the mass to charge ratio ranges of interest.

The preferred embodiment relates to methods and benefits of configuring tandem mass spectrometers so as to provide improved duty cycle for scanning devices such as quadrupoles. In semi targeted experiments such as precursor or parent ion scanning or neutral loss scanning the use of a fast and sensitive low resolution pre-scan can serve to restrict the mass to charge ratio range over which the analytical scan is performed resulting in improved speeds and/or an improved duty cycle.

According to an aspect of the present invention there is provided a mass spectrometer comprising:

a first mode of operation where the duty cycle is related to m/z range;

a second mode of operation where the m/z range or m/z ranges can quickly be determined; and a means for adjusting the parameters of the first mode of operation so as to optimise the duty cycle based on the results of the second mode of operation.

The mass spectrometer may comprise a tandem mass spectrometer such as a tandem quadrupole or a quadrupole Time of Flight mass analyser.

The first mode of operation may be a scanning or stepped quadrupole, a Time of Flight mass analyser, a magnetic sector or an ion trap.

The second mode of operation may be a scanning or stepped quadrupole, a Time of Flight mass analyser, a magnetic sector or an ion trap.

The second mode of operation may be an m/z correlated analytical approach such as ion mobility separation.

The fragmentation process may be via CID, SID, ETD or another dissociation process.

The same device may be used for multiple steps e.g. a scanning quadrupole may also act as an ion trap mass analyser or an axial Time of Flight mass analyser.

The fragmentation device may have an axial field or travelling wave to help maintain the fidelity of the pre-separation.

According to an embodiment ions may be passed back upstream and perform the same tasks.

On some instruments, e.g. ion traps, the reduced m/z range results in improved duty cycle and speed and can improve other aspects such as resolution.

On some instruments, e.g. magnetic sectors, the reduced m/z range results in improved duty cycle and speed or could improve another aspect such as mass accuracy.

Quantitative information can be retrieved from the pre-scan allowing the determination of a restricted m/z range over which saturation occurs.

The mass spectrometer may have more than two stages of fragmentation ($MS^n$).

It is recognised that many instrument parameters may be optimised from prior knowledge of the mass range or mass ranges. These include transmission windows for RF devices, collision energy parameters and ion-ion reaction times.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APR") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EIID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an orbitrap (RTM) mass analyser comprising an outer barrel-like electrode and a coaxial inner spindle-like electrode, wherein in a first mode of operation ions are transmitted to the C-trap and are then injected into the orbitrap (RTM) mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the orbitrap (RTM) mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
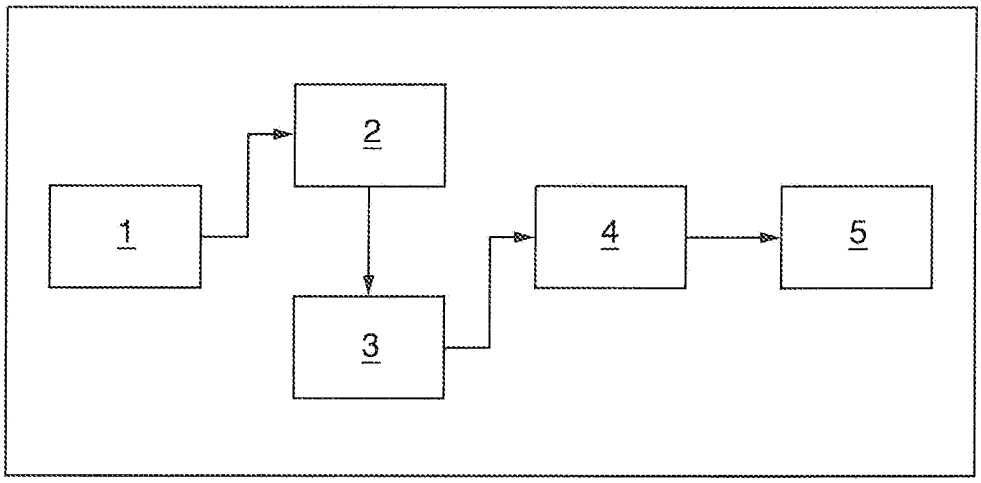
FIG. 1 shows a mass spectrometer according to an embodiment of the present invention wherein a fast analyser is provided downstream of a mass filter.

A preferred embodiment of the present invention will now be described with reference to FIG. 1. According to a preferred embodiment an ion source 1 is provided upstream of a mass filtering device 2 and a low resolution high sensitivity fast analyser 3. A fragmentation or dissociation device 4 may optionally be provided downstream of the low resolution high sensitivity fast analyser 3. A mass analyser 5 is arranged downstream of the fragmentation or dissociation device 4 and the low resolution high sensitivity fast analyser 3.

In a preferred mode of operation ions from the ion source 1 are arranged to pass through the mass filtering device 2 which is preferably operated in a non-filtering or wide mass to charge ratio range transmission mode. The ions are then onwardly transmitted to the low resolution high sensitivity fast analyser 3. A fast low resolution pre-scan of the ions is then performed by the low resolution high sensitivity fast analyser 3. The ions then pass on to the fragmentation or dissociation device 4 and are fragmented in the fragmentation or dissociation device 4. The characteristics of the fragmentation or dissociation device 4 are preferably such that the separation achieved in the low resolution high sensitivity fast analyser 3 is preferably maintained during the fragmentation and transport process. Appropriate fragment ions are then preferably analysed by the mass analyser 5 to produce a low resolution precursor ion or neutral loss scan.

Data from the low resolution scan is then used to determine the mass to charge ratio range or ranges of parent or precursor ions of interest. One or more restricted mass to charge ratio range or ranges are then scanned in a standard parent or precursor ion or neutral loss scanning experiment by scanning the mass filter 2 in a mass to charge ratio filtering mode over the restricted mass to charge ratio range or ranges. The low resolution high sensitivity fast analyser 3 is preferably switched so as to operate in a non mass to charge ratio separating mode of operation and hence functions as an ion guide.

Figure 2:
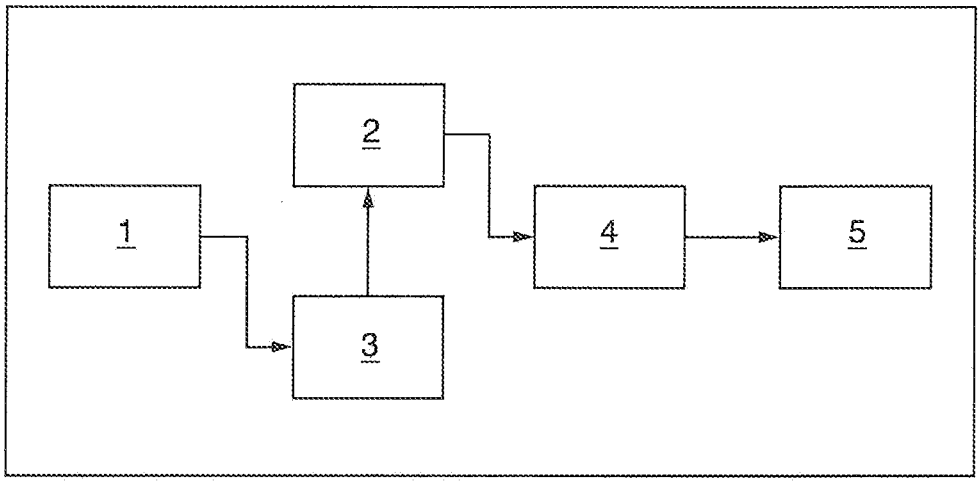
FIG. 2 shows a mass spectrometer according to an alternative embodiment wherein a fast analyser is provided upstream of a mass filter.

According to another embodiment, the ion beam may pass through the mass filtering device 2 and the low resolution high sensitivity fast analyser 3 in reverse order as shown in FIG. 2.

Figure 3:
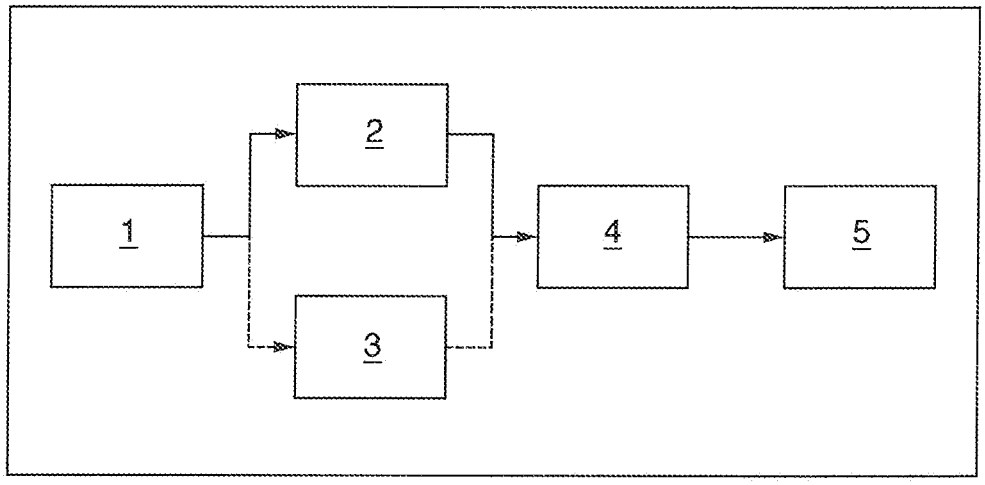
FIG. 3 shows a mass spectrometer according to an alternative embodiment wherein ions may be switched between a mass filter and a fast analyser.

According to another embodiment ions may be switched between the mass filter 2 and the low resolution high sensitivity fast analyser 3 as shown in FIG. 3.

Figure 4:
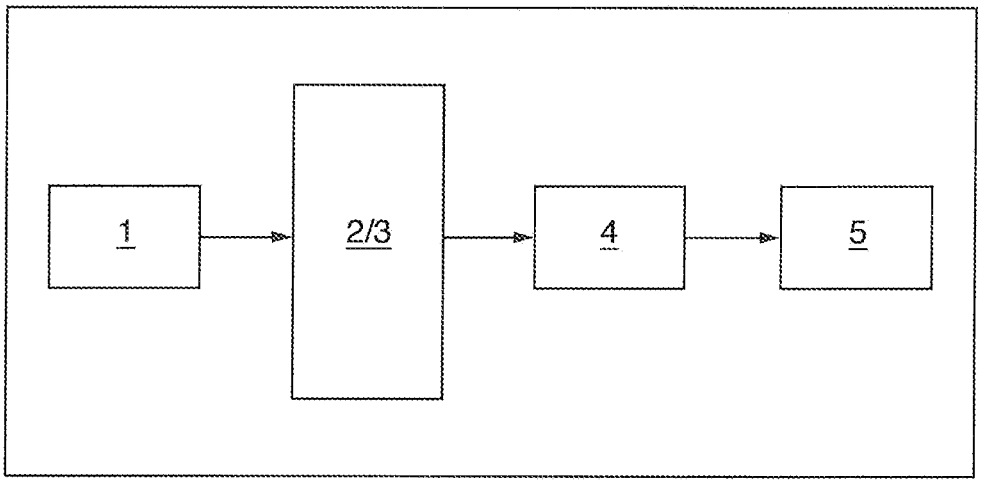
FIG. 4 shows a mass spectrometer according to a further embodiment wherein ions pass to a device which may operate either as a mass filter and/or a fast analyser.

Another preferred embodiment is shown in FIG. 4 wherein a single device 2/3 is provided which is preferably capable of functioning both as a mass filter device and as a low resolution high sensitivity fast analyser. For illustrative purposes only, the device 2/3 may comprise a 2D linear ion trap with axial ejection as, for example, disclosed in Guna et. al. J Am Soc Mass Spectrom 2009, 20, 1132-1140. The device 2/3 is preferably capable of operating either as a mass filter (e.g. quadrupole) or as a fast high sensitivity ion trap. In an ion trap mode of operation the scan speed can be as high as 20000 Dais for 0.7 Da peak widths. Higher scan rates are possible with some loss in resolution. To a first approximation a scan rate of 100000 Da/s may produce peak widths of ~5 Da. Using these figures together with a quadrupole scan speed of 2000 Da/sec and an ion trap mode overhead time of 5 ms for cooling and injection, an attempt can be made to quantify the improvements according to the preferred embodiment.

Figure 5:
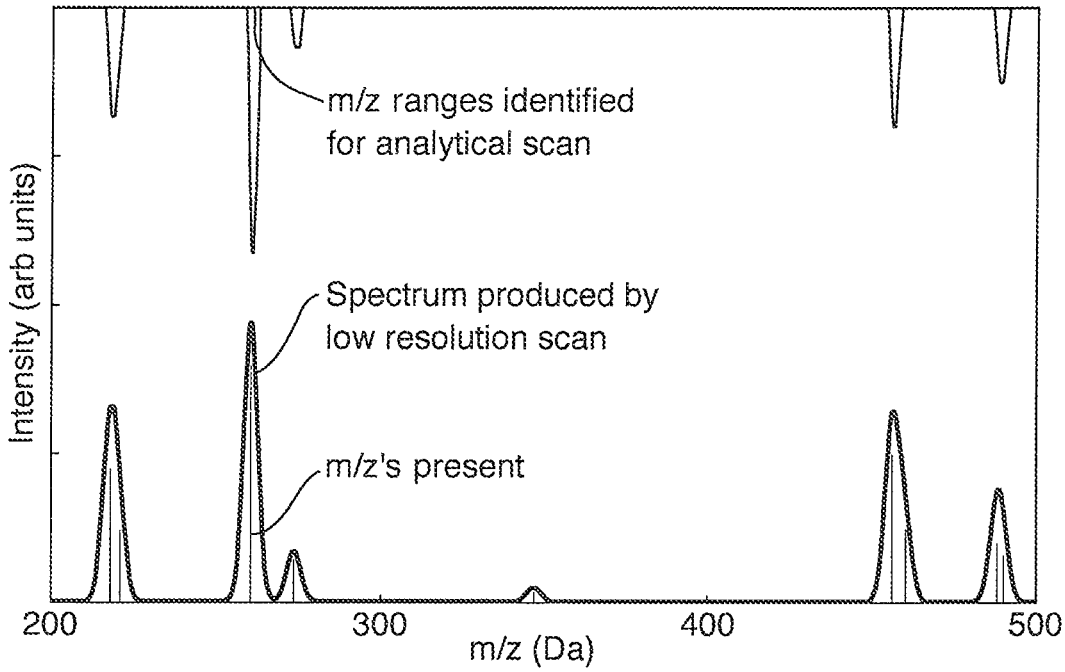
FIG. 5 shows a precursor ion scan according to an embodiment of the present invention.

FIG. 5 illustrates a precursor or parent ion scan from a neo-natal screening experiment. Nine precursor or parent ions were detected in the initial low resolution scan and are displayed along the bottom of FIG. 5. The low resolution scan took approximately 3 ms whilst the overhead for cooling and injection took 5 ms resulting in an overall trap experimental time of ~8 ms. A simple double differential and threshold peak detection resulted in the identification of multiple mass to charge ratio ranges of interest (which are displayed inverted in FIG. 5). The total mass to charge ratio ranges of interest add up to ~32 Da and take around 16 ms to scan (ignoring quadrupole settling times) resulting in an overall cycle time of around 24 ms which equates to a duty cycle improvement of over a factor of ×6 for the mass to charge ratio range shown.

It is therefore apparent that the preferred embodiment represents a significant improvement in the art.

Although the present invention has been described with reference to preferred embodiments it will be apparent to those skilled in the art that various changes in form and detail may be made without departing from the scope of the present invention as defined by the accompanying claims.

The invention claimed is:

1. A method of performing ion analysis comprising:

performing a first analysis of a sample of ions wherein one or more parameters are scanned or ions are sorted according to one or more parameters during said first analysis;

automatically determining one or more ranges of interest of said one or more parameters from said first analysis;

automatically performing a second subsequent analysis of said sample of ions, wherein said second analysis is restricted to one or more of said ranges of interest of said one or more parameters by filtering out ions having values of said one or more parameters which fall outside said one or more ranges of interest, wherein said second analysis is performed at a higher resolution than said first analysis, and wherein restricting said second analysis to analysing ions having one or more ranges of interest of said one or more parameters increases a duty cycle.

2. A method as claimed in claim 1, wherein said first analysis is performed using a first analytical device and said second analysis is performed using a second analytical device.

3. A method as claimed in claim 2, wherein said first analytical device is operated at a first resolution to perform said first analysis and said second analytical device is operated at a second higher resolution to perform said second analysis.

4. A method as claimed in claim 2, wherein said one or more parameters comprises the mass or mass to charge ratio of said ions.

5. A method as claimed in claim 4, wherein said first analytical device or said second analytical device comprise a mass analyser.

6. A method as claimed in claim 4, wherein said first analysis comprises a mass analysis of parent ions and wherein said second analysis comprises a mass analysis of similar parent ions.

7. A method as claimed in claim 4, wherein said first analysis comprises a mass analysis of first generation, second generation, third generation or subsequent generation fragment ions and wherein said second analysis comprises a mass analysis of similar first generation, second generation, third generation or subsequent generation fragment ions.

8. A method as claimed in claim 2, wherein said one or more parameters comprises ion mobility.

9. A method as claimed in claim 8, wherein said first analytical device or said second analytical device comprise an ion mobility spectrometer.

10. A method as claimed in claim 1, wherein said second analysis is substantially similar to said first analysis.

11. A method as claimed in claim 1, wherein the ions analysed during said second analysis are substantially similar to the ions analysed during said first analysis.

12. A method as claimed in claim 1 further comprises optimizing an instrument parameter based on said restricted range of interest.

13. A method as claimed in claim 12, wherein said instrument parameter comprises collision energy.

14. A method as claimed in claim 12, wherein said instrument parameter comprises ionisation energy or Electron Impact ionisation energy.

15. A method as claimed in claim 12, wherein said instrument parameter comprises Electron Transfer Dissociation conditions or a mixing or reaction time between reagent anions and analyte cations.

16. A method as claimed in claim 1, wherein in said first analysis ions are separated or sorted according to a mass or mass to charge ratio correlated parameter, and wherein said second analysis is restricted to one or more ranges of mass or mass to charge ratio of interest.

17. A method as claimed in claim 16, wherein said mass or mass to charge ratio correlated parameter comprises ion mobility.

18. A method of performing ion analysis comprising:

performing a first analysis of a sample of ions wherein one or more parameters are scanned or ions are sorted according to one or more parameters during said first analysis;

automatically determining one or more ranges of interest of said one or more parameters from said first analysis;

automatically performing a second subsequent analysis of said sample of ions, wherein said second analysis is restricted to one or more of said ranges of interest of said one or more parameters by filtering out ions having values of said one or more parameters which fall outside said one or more ranges of interest, wherein said second analysis is performed at a higher resolution than said first analysis, and wherein said first analysis and said second analysis are both performed using a first analytical device.

19. A method as claimed in claim 18, wherein said first analytical device is operated at a first resolution to perform said first analysis and is then operated at a second higher resolution to perform said second analysis.

20. An apparatus comprising:

an analyser; and a control system arranged and adapted:

(i) to perform a first analysis of a sample of ions wherein one or more parameters are scanned or ions are sorted according to one or more parameters during said first analysis;

(ii) to determine one or more ranges of interest of said one or more parameter from said first analysis; and (iii) to perform a second subsequent analysis of said sample of ions, wherein said second analysis is restricted to one or more of said ranges of interest of said one or more parameters by filtering out ions having values of said one or more parameters which fall outside said one or more ranges of interest, wherein said second analysis is performed at a higher resolution than said first analysis, and wherein restricting said second analysis to analysing ions having one or more ranges of interest of said one or more parameters increases a duty cycle.

* * * * *